US007992813B2

(12) United States Patent
Wakamatsu et al.

(10) Patent No.: US 7,992,813 B2
(45) Date of Patent: Aug. 9, 2011

(54) POWDER BASED GRANULES DISINTEGRATING AND SIZING DEVICE

(75) Inventors: Yoshihiro Wakamatsu, Sapporo (JP); Azusa Ichiki, Tokyo (JP)

(73) Assignee: Nara Machinery Co., Ltd., Tokyo (JP)

( * ) Notice: Subject to any disclaimer, the term of this patent is extended or adjusted under 35 U.S.C. 154(b) by 392 days.

(21) Appl. No.: 12/224,398

(22) PCT Filed: Feb. 26, 2007

(86) PCT No.: PCT/JP2007/054123

§ 371 (c)(1),
(2), (4) Date: Oct. 9, 2008

(87) PCT Pub. No.: WO2007/097475

PCT Pub. Date: Aug. 30, 2007

(65) Prior Publication Data

US 2009/0026297 A1 Jan. 29, 2009

(30) Foreign Application Priority Data

Feb. 27, 2006 (JP) ..... 2006-049555

(51) Int. Cl.
*B02C 13/02* (2006.01)
*B02C 7/12* (2006.01)

(52) U.S. Cl. ..... 241/86; 241/189.1; 241/297

(58) Field of Classification Search ..... 241/55, 241/188.1, 182.1, 86, 89.3, 138, 297
See application file for complete search history.

(56) References Cited

U.S. PATENT DOCUMENTS

| | | | | | |
|---|---|---|---|---|---|
| 1,682,377 | A | * | 8/1928 | Jackson | 241/56 |
| 2,013,800 | A | * | 9/1935 | Daniels | 241/56 |
| 4,081,147 | A | * | 3/1978 | Seifert et al. | 241/261.3 |
| 4,171,101 | A | * | 10/1979 | Seifert et al. | 241/30 |
| 4,214,716 | A | * | 7/1980 | Jadouin | 241/185.5 |
| 4,619,414 | A | * | 10/1986 | Kirchner et al. | 241/261.3 |
| 4,783,014 | A | * | 11/1988 | Fredriksson et al. | 241/261.2 |
| 2006/0124788 | A1 | | 6/2006 | Nara et al. | |

FOREIGN PATENT DOCUMENTS

| | | | |
|---|---|---|---|
| JP | 01-321989 | A | 12/1989 |
| JP | 06-200493 | A | 7/1994 |
| JP | 2000-117131 | | 4/2000 |
| JP | 2001-149804 | A | 6/2001 |
| JP | 2005-131609 | | 5/2005 |

* cited by examiner

*Primary Examiner* — Faye Francis
(74) *Attorney, Agent, or Firm* — Posz Law Group, PLC

(57) ABSTRACT

A powder based granules disintegrating and sizing device having a drive shaft in a horizontal direction inside a casing, a rotor fixed to the drive shaft, a sizing stator having an inclined surface, a gap section A where the powder based granules settles being formed by the plate surface of the rotor and the inclined surface of the sizing stator, and a disintegrating and sizing section B being formed by the narrowest gap section between the circumferential edge of the rotor and the sizing stator. The drive shaft is supported in a cantilever fashion, the rotor is fixed to an open side end portion thereof, the sizing stator is installed over the whole circumference of the rotor, a raw material supply port is opened in the vicinity of the central portion of the rotor, and a product output port is opened in the vicinity of position directly below the rotor.

20 Claims, 12 Drawing Sheets

POWDER BASED GRANULES DISINTEGRATING AND SIZING DEVICE

CROSS REFERENCE TO RELATED APPLICATIONS

This application is a U.S. national stage application of PCT/JP2007/054123 filed on Feb. 26, 2007, and claims priority to, and incorporates by reference, Japanese Patent Application No. 2006-49555, filed on Feb. 27, 2006.

TECHNICAL FIELD

The present invention relates to a powder based granules disintegrating and sizing device which regulates, to a prescribed particle size, various types of wet or dry material such as pharmaceuticals, food products, feed materials, chemicals, fertilizers, fine coals, limestone, ceramic materials or the like, which have been granulated or molded articles by various types of devices. More specifically, the present invention relates to a powder based granules disintegrating and sizing device which disintegrates granular material (lumps) having a particle size that is equal to or larger than a target particle size, such as wet agglomerated material or dry block material that has been granulated or molded articles by various types of devices, and regulates the material to a prescribed particle size range.

BACKGROUND

Nowadays, the operations of mixing, granulating and regulating the particle size of power material are carried out in a broad range of fields, such as pharmaceuticals and foodstuffs. Therefore, the particle size adjustment operation carried out in a product manufacture process is an important unit operation in improving the quality of the powder based granules, improving the flowability during fluidized drying and improving the handling properties.

Here, in powder based granules disintegrating and sizing devices which have been used in the prior art, the particle size is regulated by the use of screens. Consequently, there is a possibility that with continuous use, the screen will become worn and damaged, and worn particles or broken shards of the screen may become mixed into the product powder based granules. Furthermore, in the case of a wet material, depending on the physical properties of the material being processed, blocking of the screen mesh holes occurs due to the adherence of material, and there is a risk that material being processed may become clogged into the screen. Moreover, there has also been a problem in that particles which are of a suitable particle size are also disintegrated due to the force of impact of the disintegrating blade, and hence a large amount of fine-particles are generated, resulting in a decline in the yield rate.

Therefore, the present applicants have previously developed a powder based granules disintegrating and sizing device which does not use a screen, and have filed patent applications in this respect (Japanese Patent Application Publication No. 2000-117131 (hereinafter, Patent Document 1), Japanese Patent Application Publication No. 2005-131609 (hereinafter, Patent Document 2), and WO 2004/085069 A1 publication (hereinafter, Patent Document 3).

These powder based granules disintegrating and sizing devices are devices which regulate the size of the particles of a wet or dry material supplied via a material supply port by passing the material through a prescribed settlement region, a gap region being formed by providing a rotating body and an opposing surface section which opposes the rotating body and is separated from same by a prescribed gap, inside a casing which constitutes the device, and this gap region being constituted as a particle size adjustment region which allows the passage of particles that conform to the prescribed gap setting but does not permit the passage of particles that do not conform to same, in such a manner that the particles which are not able to pass through the gap region are brought into contact with the opposing surface section due to the rotational movement of the rotating body, in the input section or surface section of the gap region, and are thereby disintegrated so as to be able to pass through the gap region and are then output through the output port.

In the gap region, the rotating body and the opposing surface section are provided with a planar section or a linear section which is set so as to form a narrowest gap section, in such a manner that the particles are disintegrated in this narrowest gap region or in the vicinity thereof.

More specifically, in the powder based granules disintegrating and sizing devices described in Patent Document 1 and Patent Document 2, a rotating body fixed to a drive shaft provided in a vertical direction is formed in a substantially circular conical shape, the casing is formed in a substantially hollow circular conical shape, and a settlement region for the powder based granules material is formed between the inner wall of the casing and the circumferential surface of the rotating body, the narrowest gap region being formed by the lower circumferential edge of the rotating body and the inner wall of the casing.

Furthermore, in the powder based granules disintegrating and sizing device described in Patent Document 3, a drive shaft is provided in a horizontal direction inside a casing, and a plurality of circular plates (rotating bodies) fixed at intervals to the drive shaft are provided, together with sizing stators, which are disposed to the lower side of the circular plates so as to create resistance with respect to the surface of the plate in the circumferential edge portion thereof and which have an inclined surface that reduces the gap with respect to the plate surface of the circular plate toward the circumferential edge plurality of same, gap sections in which the powder based granules particles settle being formed by the plate surfaces of the circular plates and the inclined surfaces of the sizing stator, and disintegrating and sizing sections being formed by the narrowest gap regions between the circumferential edges of the circular plates and the sizing stators.

However, firstly, in the powder based granules disintegrating and sizing devices described in Patent Document 1 and Patent Document 2, since the drive shaft is disposed in the vertical direction, then the direction of the centrifugal force applied to the powder based granules particles by the rotating body which is caused to rotated by the drive shaft is a horizontal direction which is perpendicular to the direction of gravity. Therefore, the powder based granules particles, from the time that they are supplied and subjected to disintegrating and sizing until the time that they are output, receive forces in various directions from the rotating body, the internal walls of the casing, and the like, thus acquiring a complicated motion, and hence a smooth flow of powder based granules particles is not formed inside those machines. As a result of this, in a disintegrating and sizing process for a dried powder based granules, for example, the settlement time of the powder based granules inside the device becomes long and there is a tendency for a large number of fine-particles to be generated. Furthermore, in a disintegrating and sizing process for a wet powder based granules material, since a smooth flow cannot be formed, then there is a drawback in that a large amount of material adheres to the internal walls of the device.

Moreover, in the powder based granules disintegrating and sizing device described in Patent Document 3, a sizing stator is provided only on the lower side of the circular plates, and therefore no disintegrating and sizing action occurs on the upper side of the circular plates, and the efficiency is poor. Furthermore, since the powder based granules material being processed is supplied from the upper side of the circular plates, then it rebounds due to the centrifugal force of the circular plates and does not enter readily into the device. Moreover, since the drive shaft disposed in the horizontal direction has a structure which is supported at either end, then the size of the device increases, and furthermore, there is a risk that oil and the like from the supporting sections will enter into the casing, in other words, into the powder based granules processing chamber, thus making this device unsuitable for the processing of powder based granules where infiltration of impurities is to be avoided, such as pharmaceuticals, food products, or the like.

Furthermore, in all of the powder based granules disintegrating and sizing devices described in the Patent Documents mentioned above, the gap in the sizing section, in other words, the particle size, is adjusted by means of an operator observing the particle size of the product and then selecting a member of a suitable thickness from a plurality of types of ring members or size regulating stators having different thicknesses, and installing the selected ring member or size regulating stator. Consequently, this adjustment task takes time, and skill and physical strength are required in order to replace the ring member or size regulating stator. Furthermore, since it is necessary to prepare a plurality of ring members and size regulating stators having different thicknesses, then the management of these members or stators becomes complicated.

DISCLOSURE OF THE INVENTION

The present invention was devised in view of the aforementioned problems of the prior art, an object thereof being to provide a powder based granules disintegrating and sizing device whereby the flow of powder based granules material supplied into the device is improved, adherence of material to the internal walls of the device and excessive disintegrating are prevented, and furthermore, the processing amount can be increased.

Moreover, it is an object of the present invention to provide a powder based granules disintegrating and sizing device capable of achieving a disintegrating and sizing process in which impurities are not liable to infiltrate, and in which the particle size can be adjusted readily.

In order to achieve the aforementioned objects, the present invention provides a powder based granules disintegrating and sizing device having the following composition.

(1) A powder based granules disintegrating and sizing device, having a drive shaft which is provided in a horizontal direction inside a casing, a rotor which is fixed to the drive shaft, and a sizing stator which is provided so as to oppose a plate surface of a circumferential edge portion of the rotor and has an inclined surface which reduces a gap with respect to the plate surface of the rotor toward the circumferential edge thereof, a gap section where the powder based granules settles being formed by the plate surface of the rotor and the inclined surface of the sizing stator, and a disintegrating and sizing section being formed by a narrowest gap section between the circumferential edge of the rotor and the sizing stator, wherein the drive shaft is supported in a cantilever fashion, the rotor is fixed to an open side end portion thereof, the sizing stator is installed over the whole circumference of the rotor, a raw material supply port is opened in the vicinity of the central portion of the rotor, and a product output port is opened in the vicinity of a position directly below the rotor.

According to the powder based granules disintegrating and sizing device described in (1) above, a disintegrating and sizing section is formed over the whole circumference of the rotor, and the powder based granules can be disintegrating and regulated in size efficiently. Moreover, since the powder based granules being processed is supplied in the vicinity of the center of the rotor, flows due to the centrifugal force of the rotor from the center toward the outer circumference of the rotor, where it receives a disintegrating and sizing action, and is then output directly in the outer circumferential direction, then the flow of powder based granules inside the device is smooth, adherence of the processed material to the internal walls of the device can be prevented, excessive disintegrating can be avoided, and furthermore, the processing amount can be increased.

(2) The powder based granules disintegrating and sizing device according to (1) above, wherein the casing is constituted by a casing main body having a bottomed cylindrical shape and a front cover which seals the open end of the casing main body, the raw material supply port is opened in the central portion of the front cover, and the product output port is opened in the lower circumferential surface portion of the casing main body.

According to the powder based granules disintegrating and sizing device described in (2) above, it is possible to form the casing to a compact size, the interior of the casing can be cleaned and inspected, etc., easily, and the flow of processed material can be made even smoother.

(3) The powder based granules disintegrating and sizing device according to (2) above, wherein the sizing stator is installed on the front cover in such a manner that the projecting position thereof can be adjusted.

According to the powder based granules disintegrating and sizing device described in (3) above, it is possible to adjust the gap between the sizing stator and the circumferential edge section of the rotor, in other words, the gap of the disintegrating and sizing section, by adjusting the projecting position of the sizing stator, and therefore the particle size of the processed material can be adjusted readily.

(4) The powder based granules disintegrating and sizing device according to any one of (1) to (3) above, wherein a cutaway section is formed in the circumferential edge of the rotor on the front side thereof, and a sizing ring is installed in the cutaway section.

According to the powder based granules disintegrating and sizing device described in (4) above, it is possible to adjust the gap of the disintegrating and sizing section by altering the thickness of the sizing ring, and it is also possible to carry out a suitable disintegrating and sizing process in accordance with the powder based granules material, by altering the shape of the sizing ring in accordance with the properties of the powder based granules being processed.

(5) The powder based granules disintegrating and sizing device according to (4) above, wherein two types of sizing stator are provided, one having a flat sizing surface and one having a sizing surface formed with projecting portions, and three types of sizing ring are provided, one having a flat sizing surface, one having a sizing surface formed with grooves and one having a sizing surface formed with projecting portions, the sizing stator and the sizing ring being installed on the front cover and the rotor respectively, in accordance with the properties of the powder based granules which is subjected to sizing processing.

According to the powder based granules disintegrating and sizing device described in (5) above, since sizing stators and sizing rings with sizing surfaces which are flat, grooved or have projecting portions are prepared as the sizing stator and the sizing ring that constitute the disintegrating and sizing section, then it is possible to adapt suitably to powder based granules having various properties, by means of the combination of the stator and ring used. Furthermore, since respective sizing stators and sizing rings having different shapes are prepared, one of each shape respectively, then they can be managed easily.

(6) The powder based granules disintegrating and sizing device according to any one of (1) to (5) above, wherein an air seal section is provided between a bearing section of the drive shaft and the casing.

According to the powder based granules disintegrating and sizing device described in (6) above, since oil and the like from bearing sections does not infiltrate into the casing, in other words, into the powder based granules processing chamber, then the device is suitable for use in a disintegrating and sizing processing for material where admixture of impurities must be avoided, such as pharmaceuticals, food products, and the like.

(7) The powder based granules disintegrating and sizing device according to any one of (1) to (6) above, wherein disintegrating pins which roughly crush the powder based granules are provided on a front side plate surface of the rotor.

According to the powder based granules disintegrating and sizing device described in (7) above, even in cases where the powder based granules settles in between the plate surface of the rotor and the inclined surface of the sizing stator, or the like, the disintegrating pins provided on the plate surface of the rotor roughly crush the powder based granules and are therefore able to aid the disintegrating and sizing action performed by the narrowest gap section, and the like.

(8) The powder based granules disintegrating and sizing device according to any one of (1) to (7) above, wherein auxiliary pins which press the powder based granules in the direction of the disintegrating and sizing section are provided on a front side plate surface of the rotor.

According to the powder based granules disintegrating and sizing device described in (8) above, the auxiliary pins provided on the plate surface of the rotor have an action of pushing the powder based granules out into the disintegrating and sizing section, and therefore the powder based granules is not liable to settle and the processing amount can be increased yet further.

BRIEF DESCRIPTION OF THE DRAWINGS

FIGS. 6A and 6B are diagrams showing an enlarged view of the principal part of a powder based granules disintegrating and sizing device relating to the present invention, in which FIG. 6A is a cross-sectional view and FIG. 6B is a diagram viewed in the X direction in FIG. 6A;

FIGS. 7A and 7B are diagrams showing a further embodiment of a sizing ring which is installed on the rotor, in which FIG. 7A is a front view and FIG. 7B is a partial enlarged cross-sectional view along A-A in FIG. 7A;

FIGS. 8A and 8B are diagrams showing yet a further embodiment of a sizing ring which is installed on the rotor, in which FIG. 8A is a front view and FIG. 8B is a partial enlarged cross-sectional view along B-B in FIG. 8A;

FIGS. 9A and 9B are diagrams showing a further embodiment of a sizing stator which is installed on the front cover, in which FIG. 9A is a front view and FIG. 9B is a partial enlarged cross-sectional view along C-C in FIG. 8A;

BEST MODE FOR CARRYING OUT THE INVENTION

Hereinafter, the powder based granules disintegrating and sizing device relating to the present invention which was described above will be explained in detail on the basis of embodiments which are shown in the accompanying drawings.

Figure 2:
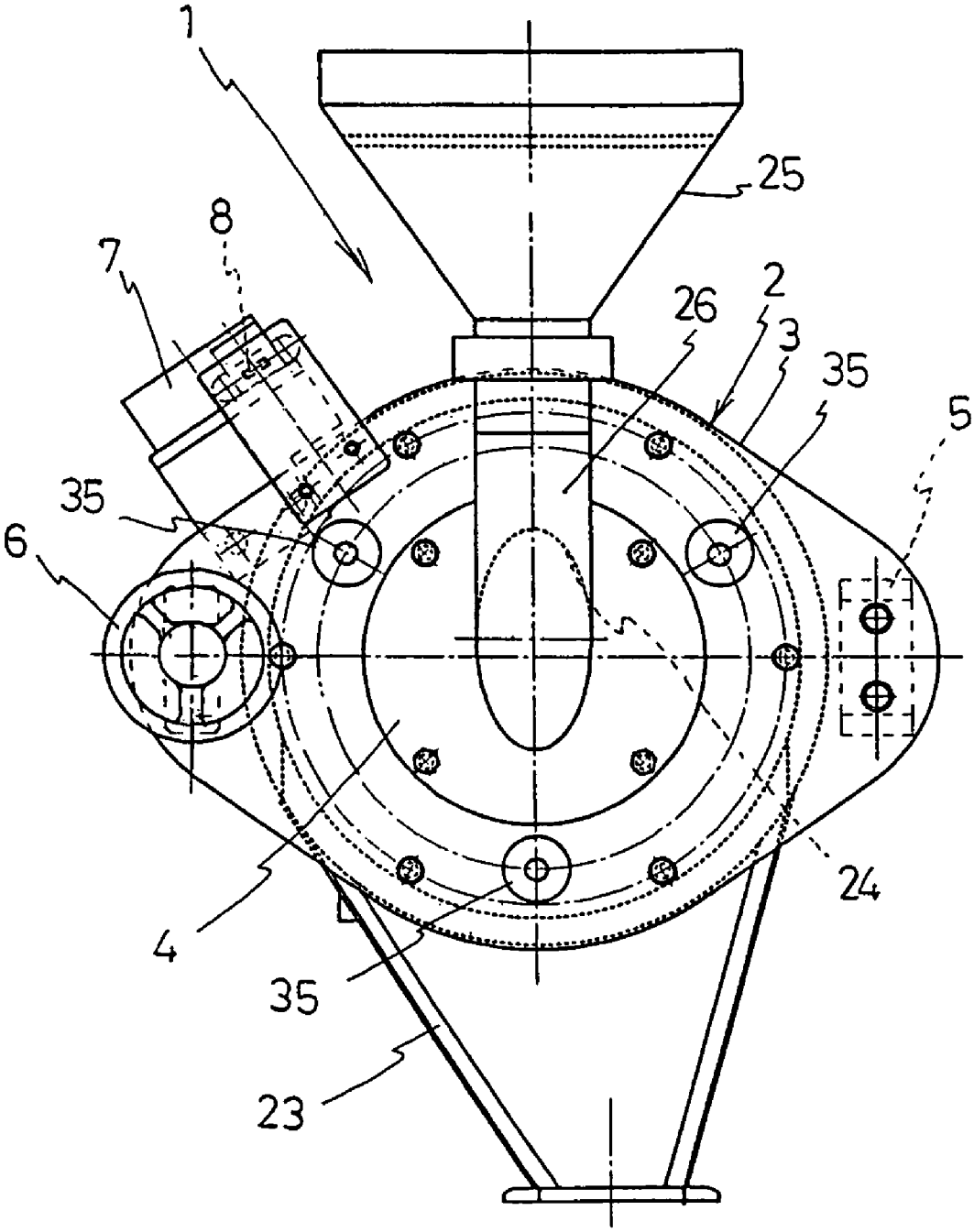
FIG. 2 is a front view of the powder based granules disintegrating and sizing device shown in FIG. 1.
Figure 3:
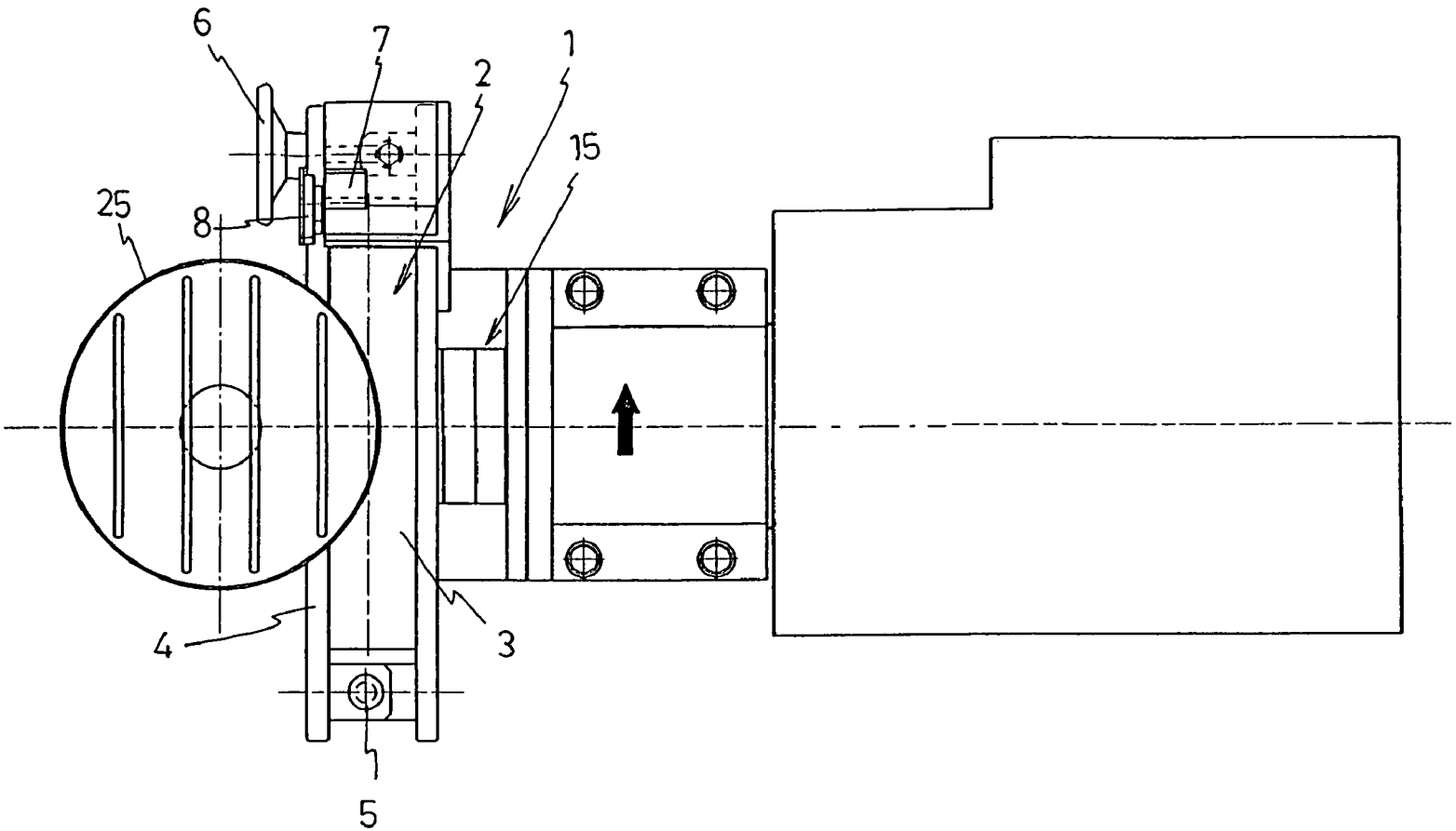
FIG. 3 is a plan view of the powder based granules disintegrating and sizing device shown in FIG. 1.

The powder based granules disintegrating and sizing device 1 relating the present invention which is shown in the drawings has a casing 2 which comprises a casing main body 3 in the form of a bottomed circular tube, and a front cover 4 which seals off the open end of this casing main body 3. As shown in FIG. 2 and FIG. 3, the front cover 4 is installed on the casing main body 3 via a hinge 5 in one side portion, and is composed so as to be openable and closable in the horizontal direction by a rotating action of a handle 6 which is provided in the other side portion of the casing main body 3. Furthermore, as shown in FIG. 2, an electromagnetic lock safety door switch 7 is provided on the upper part of the casing main body 3, and a key 8 which operates this door switch 7 is provided in a position opposing the front cover 4, in such a manner that the disintegrating and sizing device 1 does not operate when the front cover 4 is in an open state.

Figure 1:
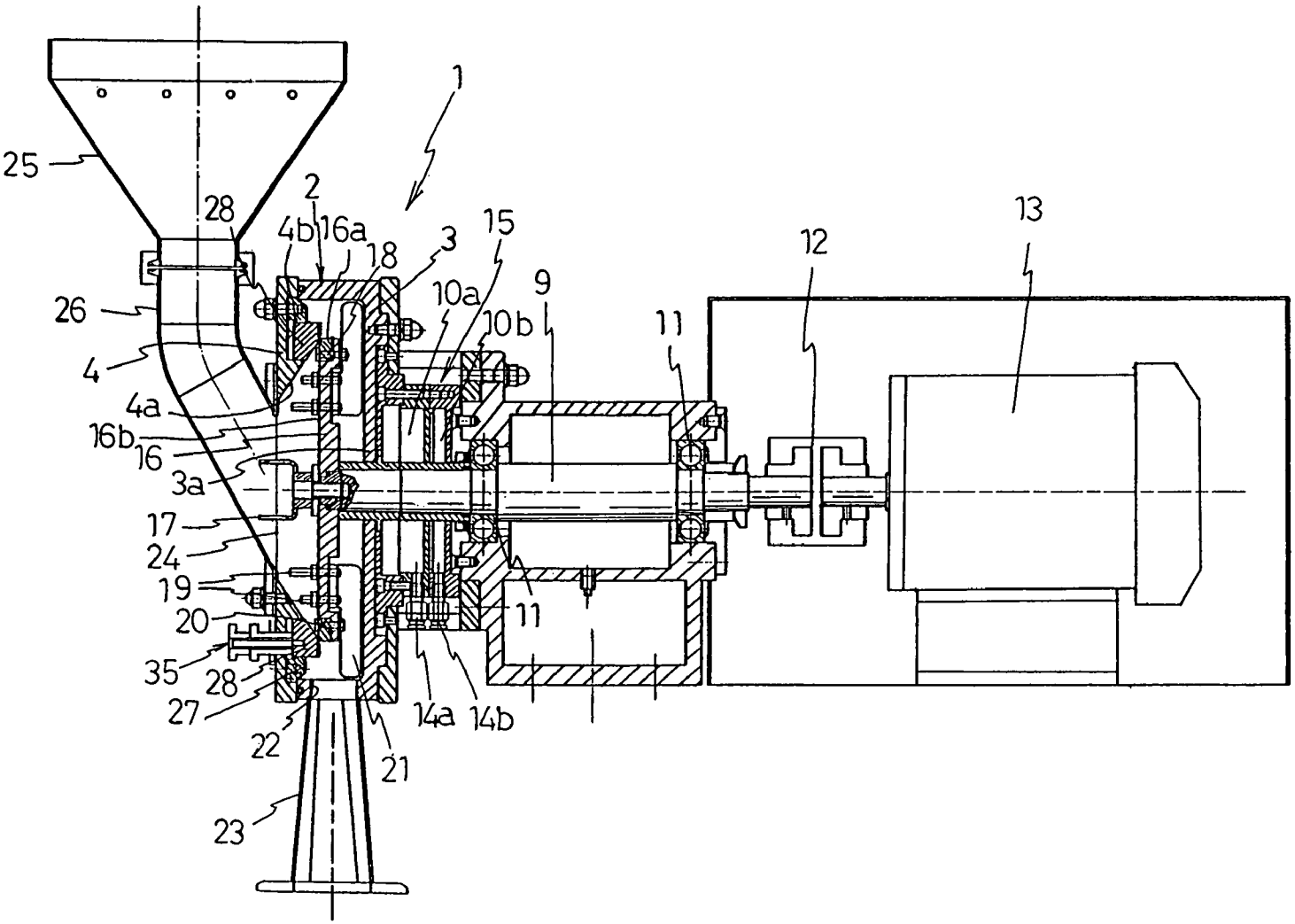
FIG. 1 is a cross-sectional side view showing one embodiment of a powder based granules disintegrating and sizing device according to the present invention.

A drive shaft 9 is provided in a horizontal direction inside the casing 2, and one end of this drive shaft 9 is extended to the exterior through the bottom wall 3*a* of the casing main body 3, as shown in FIG. 1. This end of the drive shaft 9 is supported on bearings 11, 11 via two sealed boxes 10*a*, 10*b*, and is coupled to a motor 13 by means of a chain coupling 12. An air supply port 14*a* and an excess air exhaust port 14*b* are provided respectively in the sealed boxes 10*a* and 10*b*. In this way, an air seal section 15 is created wherein, by evacuating a portion of the air in the sealed boxes 10*a* and 10*b* to the interior of the casing 2, the material being processed is prevented from entering into the bearing 11, and the oil, or the like, of the bearing 11 is prevented from entering into the casing 2.

Figure 4:
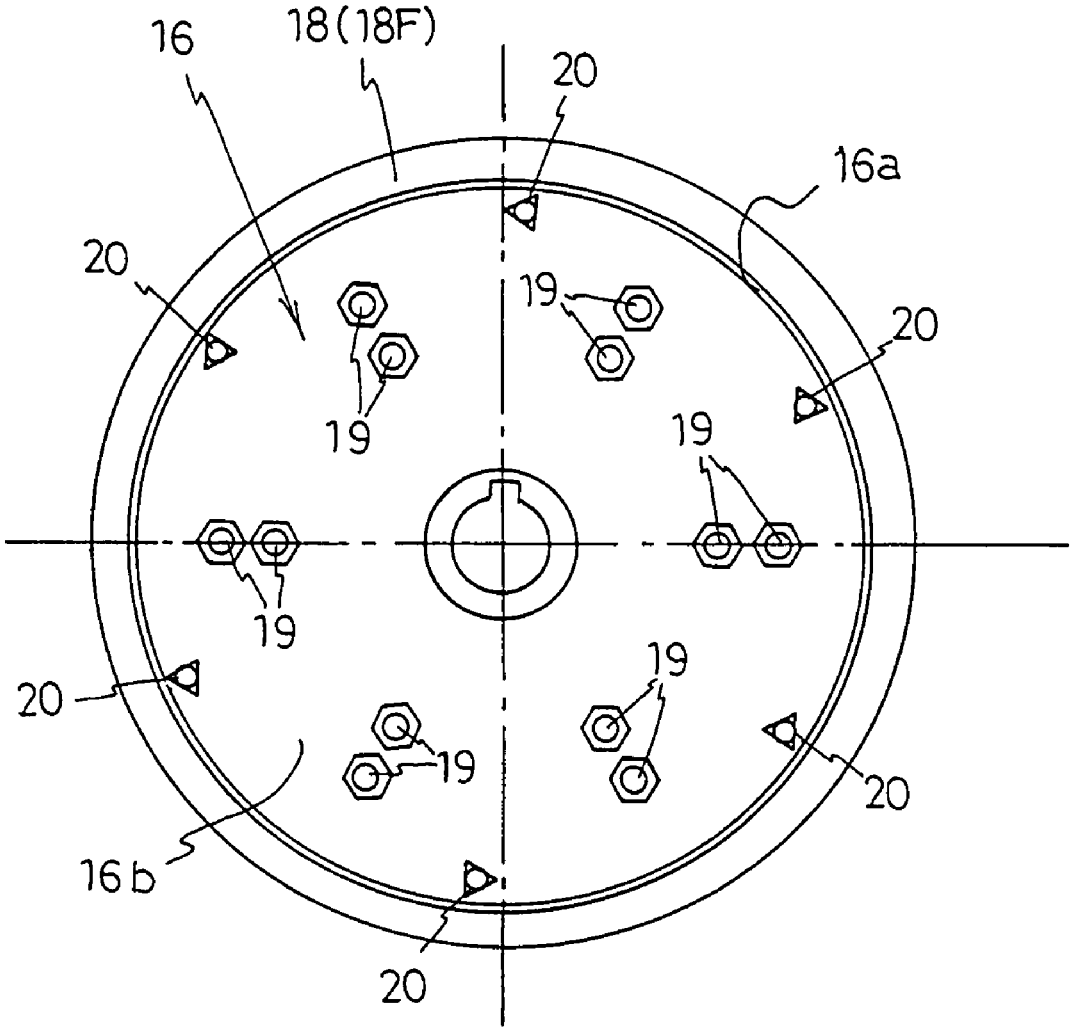
FIG. 4 is a front view showing one embodiment of a rotor used in the powder based granules disintegrating and sizing device according to the present invention.

A rotor (circular plate) 16 is fixed to the open side end portion of the drive shaft 9 which is disposed inside the casing 2. A U-shaped disintegrating bar 17 is installed on the front end of the drive shaft 9. A cutaway section 16*a* is formed in the outer edge of the front side of the rotor 16, and a sizing ring 18 is installed in this cutaway section 16*a*. Furthermore, as shown in FIG. 1 and FIG. 4, and other drawings, couples of long and short disintegrating pins 19 are installed respectively on the front side plate surface of the rotor 16 at uniform intervals of 60 degrees in the circumferential direction. Moreover, six auxiliary pins 20 are installed at equidistant intervals about the circumference of the rotor 16, at positions between the size regulating ring 18 and the disintegrating pins 19. Four rear vanes 21 are installed in a radiating direction on the rear surface side of the rotor 16. Furthermore, a product output port 22 is provided in the lower circumferential surface portion of the casing main body 3, at a position directly below the rotor 16, and an output chute 23 is connected to same.

A raw material supply port 24 is provided in the central portion of the front cover 4, and the chute 26 of a hopper 25 is connected to this raw material supply port 24. Moreover, as described in detail in FIG. 5, the cover 4 has an inclined surface 4*a* which gradually becomes thicker from the raw material supply port 24, and it is formed with a cutaway section 4*b* at a position opposing the outer edge of the rotor 16. A sizing stator 28 which is registered in position by a stopper ring 27 is installed in the cutaway section 4*b* in such a manner that its outflow position can be adjusted. This sizing stator 28 has an inclined surface 28*a* which is connected to the inclined surface 4*a* of the front cover 4, and a vertical surface 28*b*.

Figure 5:
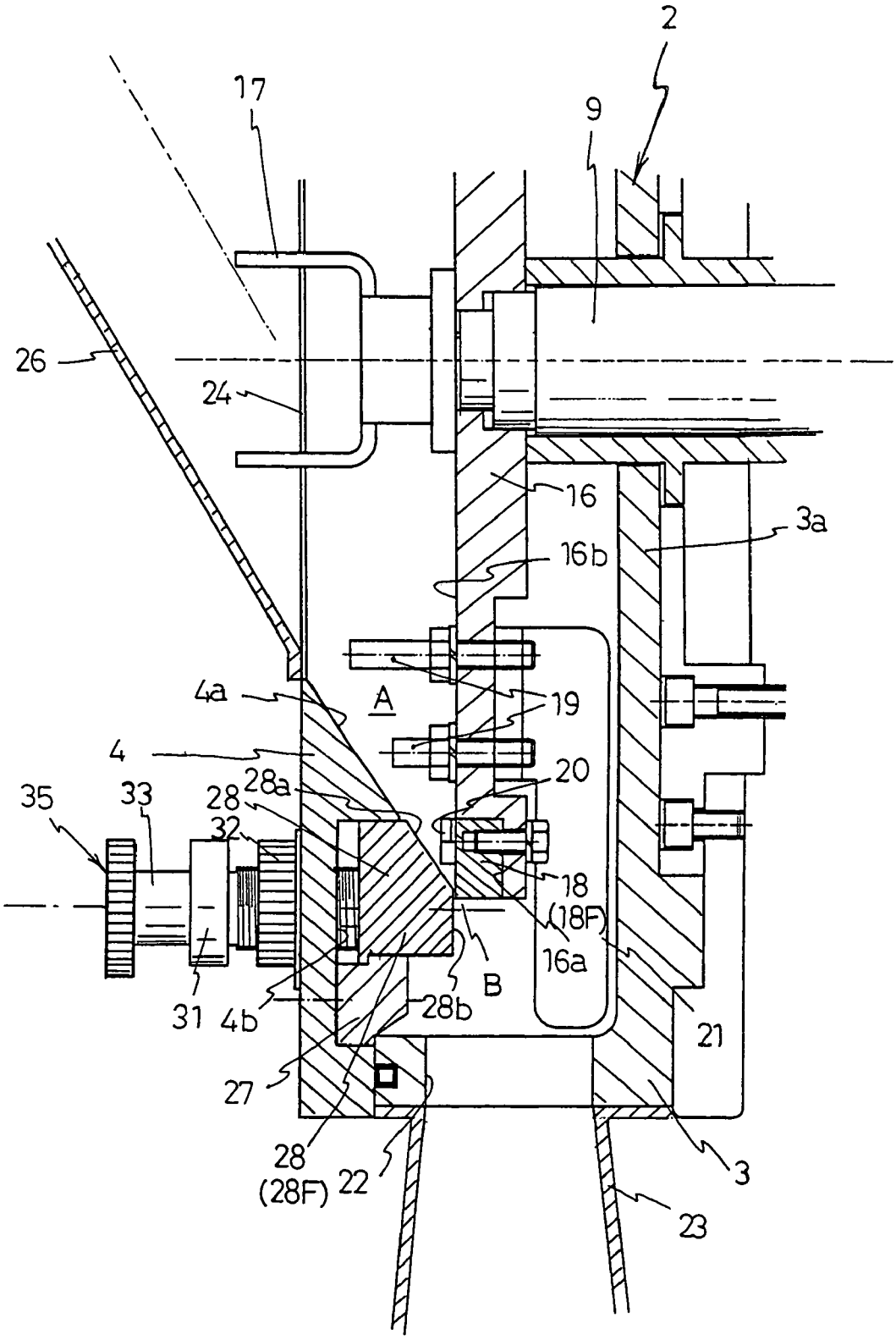
FIG. 5 is a cross-sectional view showing an enlarged view of the principal part of a powder based granules disintegrating and sizing device relating to the present invention.

As shown in FIG. 5, the rotor 16 and the front cover 4 form a gap section A in which the gap created between the front side plate surface 16*b* of the rotor 16, and the inclined surface 4*a* of the front cover 4 and the inclined surface 28*a* of the sizing stator 28 gradually becomes narrower toward the outer edge of the rotor 16. Furthermore, a disintegrating and sizing section B is formed between the sizing ring 18 on the outermost edge of the rotor 16 and the vertical surface 28*b* of the sizing stator 28, in other words, in the narrowest gap region of the gap section A.

Figure 6A:
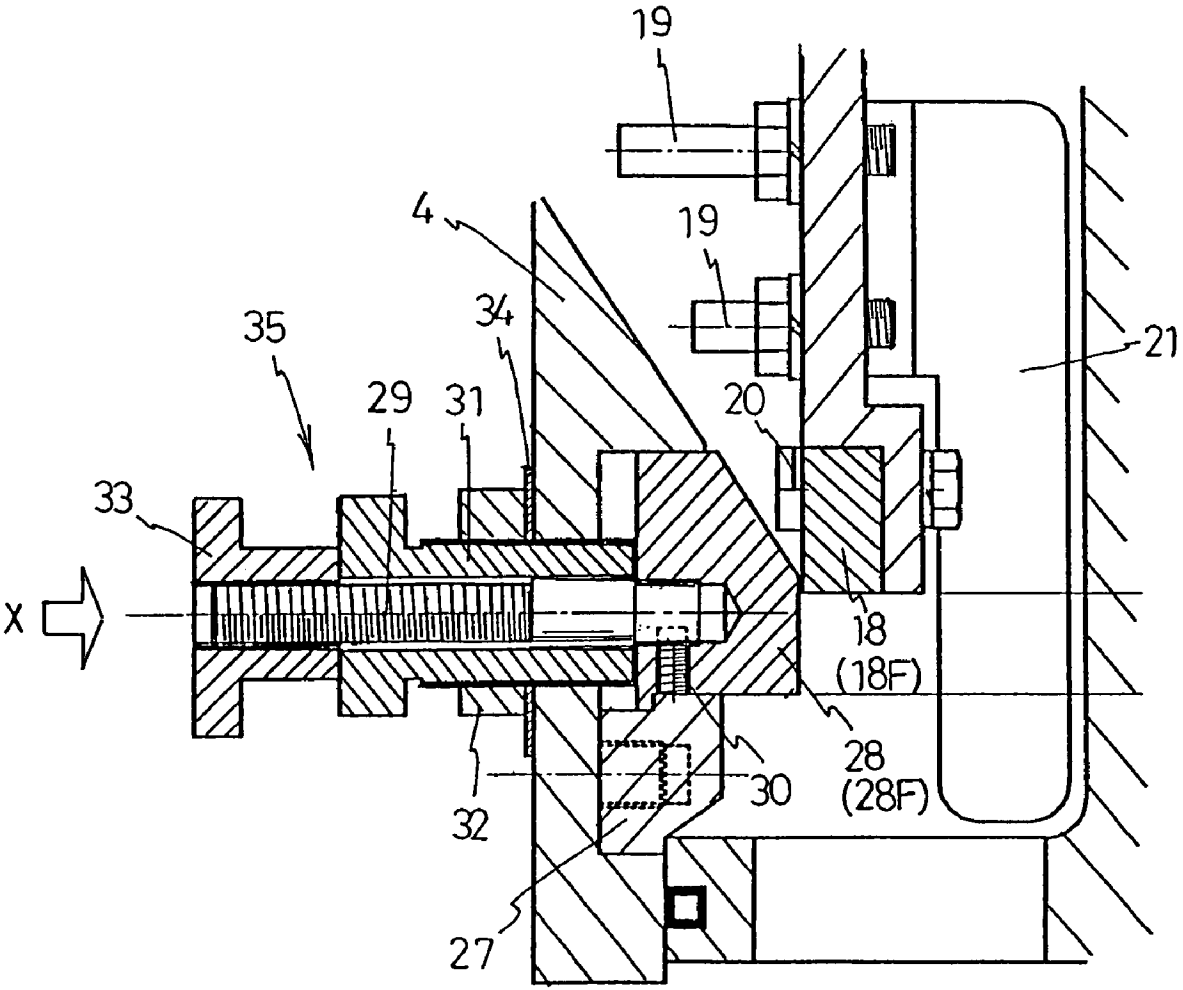
Figure 6B:
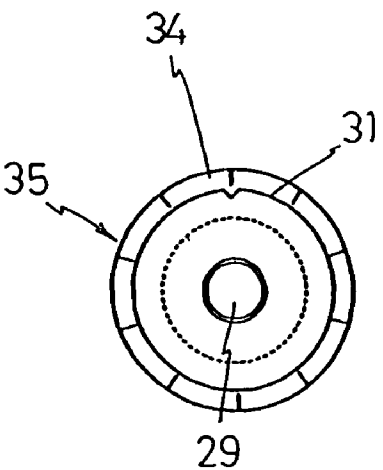

The gap of the disintegrating and sizing section (narrowest gap section) B is set as desired in accordance with the target maximum particle size or average particle size of the powder based granules being processed. In general, the gap of the disintegrating and sizing section (narrowest gap section) B is set to approximately 0.8 to 1 times the target maximum particle size or to approximately 1.5 to 3 times the target average particle size of the powder based granules being processed. The gap of the disintegrating and sizing section (narrowest gap section) B can be adjusted readily, by altering the projecting position of the sizing stator 28 which is installed on the front cover 4. In other words, in the present embodiment, as shown in detail in FIG. 6, a stud bolt 29 is fixed by a hexagonal socket head screw 30 to the sizing stator 28, and a spacer 31 which fits freely onto the stud bolt 29 and which determines the projecting position of the sizing stator 28, is fixed to the front cover 4 by means of a nut 32 which screws onto the outer circumference of the spacer 31 and a knurled knob 33 which screws onto the stud bolt 29. To adjust the gap, firstly, the nut 32 and the knurled knob 33 are loosened, thereby setting the spacer 31 to a movable state, the spacer 31 is rotated in accordance with the measurement markings on a gauge plate 34, thereby adjusting the projecting position of the sizing stator 28, and the nut 32 and the knurled knob 33 are then fastened, thereby fixing the position of the spacer 31. As shown in FIG. 2, the projecting position adjustment mechanism 35 of the sizing stator 28 which was described above is provided respectively at three points on the front cover 4, at intervals of 120 degrees apart. By operating these three projecting position adjustment mechanisms 35, the sizing stator 28 disposed inside the casing 2 is moved from outside the casing 2, thereby adjusting the gap of the disintegrating and sizing section (narrowest gap section) B. In the present embodiment, as shown in FIG. 6B, ten measurement markings are applied to the gauge plate 34 and when the spacer 31 is rotated either to the right or left by one marking, the sizing stator 28 is caused to advance or retreat through 0.1 mm in the projecting direction.

As shown in FIG. 5 or the like, the sizing ring 18 installed on the outermost edge of the rotor 16 and the sizing stator 28 installed on the front cover 4 which form the disintegrating and sizing section described above (the narrowest gap section) B, generally both have flat sizing surfaces. In the case of a powder based granules which breaks up readily even when in a dry state, a combination of a flat sizing ring 18F and a flat sizing stator 28F is used. However, it is also possible to use a suitable combination of the sizing ring 18 and the sizing stator 28 which have grooves, projecting portions (spikes) and the like, on the sizing surfaces thereof. In this case, it is possible to alter the disintegrating and sizing function, as well as achieving a function of pushing the powder based granules smoothly toward the output side, or conversely a function of causing the powder based granules to settle in the gap section A, and hence it is possible to carry out a suitable disintegrating and sizing process, in accordance with the properties of the powder based granules being processed.

Figure 7A:
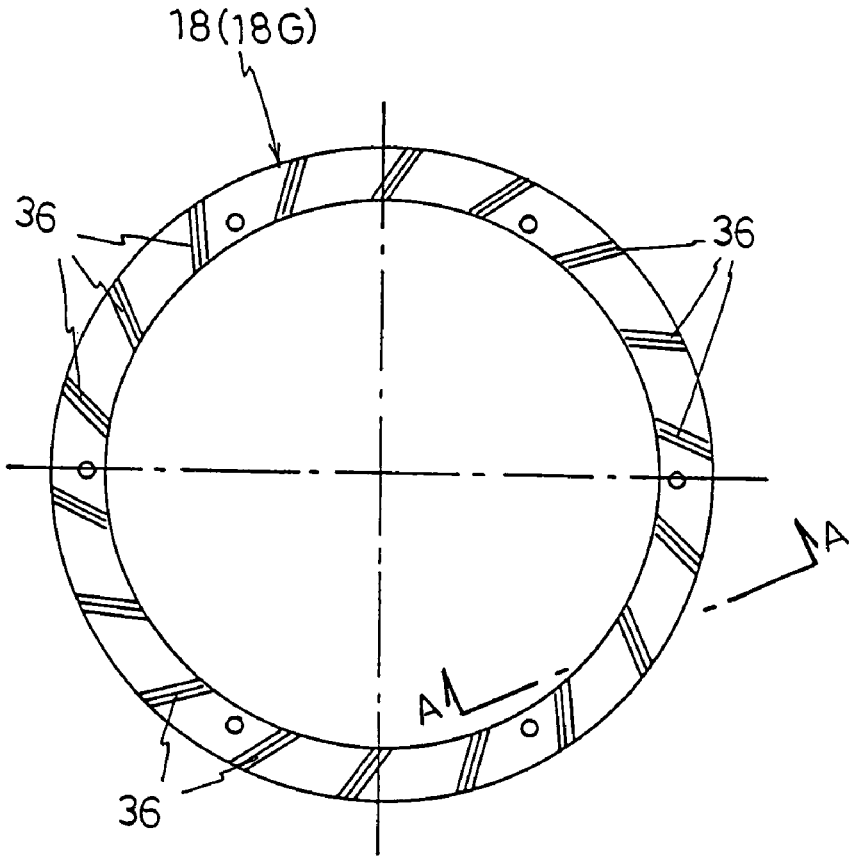
Figure 7B:
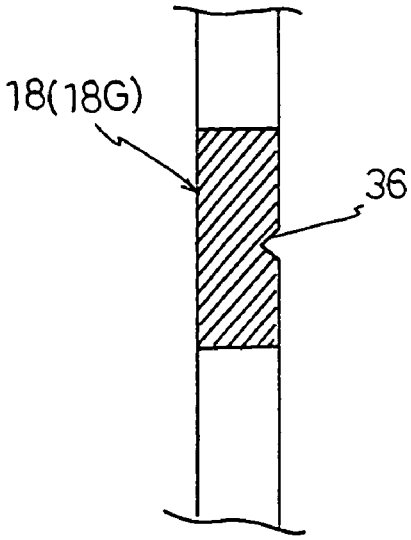

For example, as shown in FIGS. 7A and 7B, a sizing ring 18G which has grooves 36 inclined at a prescribed angle in the direction of rotation formed at prescribed intervals apart in the plate surface of the ring can be used for the sizing ring 18 which is fitted to the rotor 16, and a general flat sizing stator 28F can be used for the sizing stator 28 which opposes this sizing ring 18G. In this case, since the grooves 36 are cut in a direction which facilitates the expulsion of the processed material, then the composition is suited to cases where material which is liable to adhere to the device is subjected to a sizing process, or where material having a long, thin and substantially circular bar shape which is formed as an extruded powder based granules product, is cut up into uniform lengths and then subjected to a sizing process, or the like.

Figure 8A:
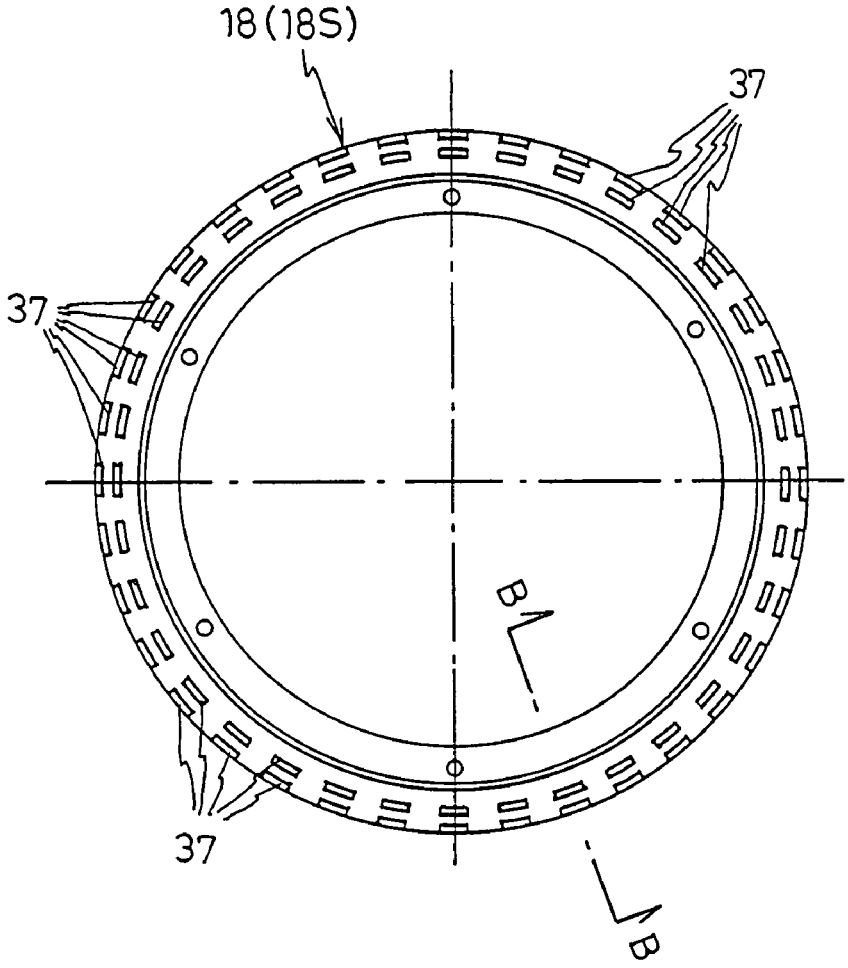
Figure 8B:
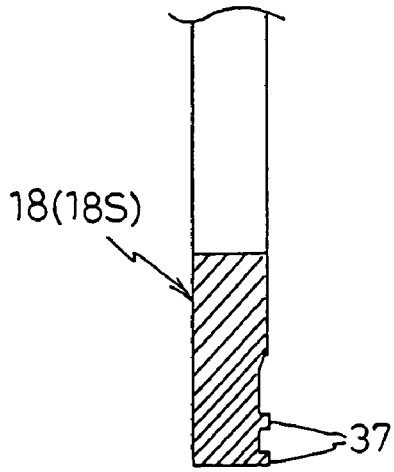
Figure 9A:
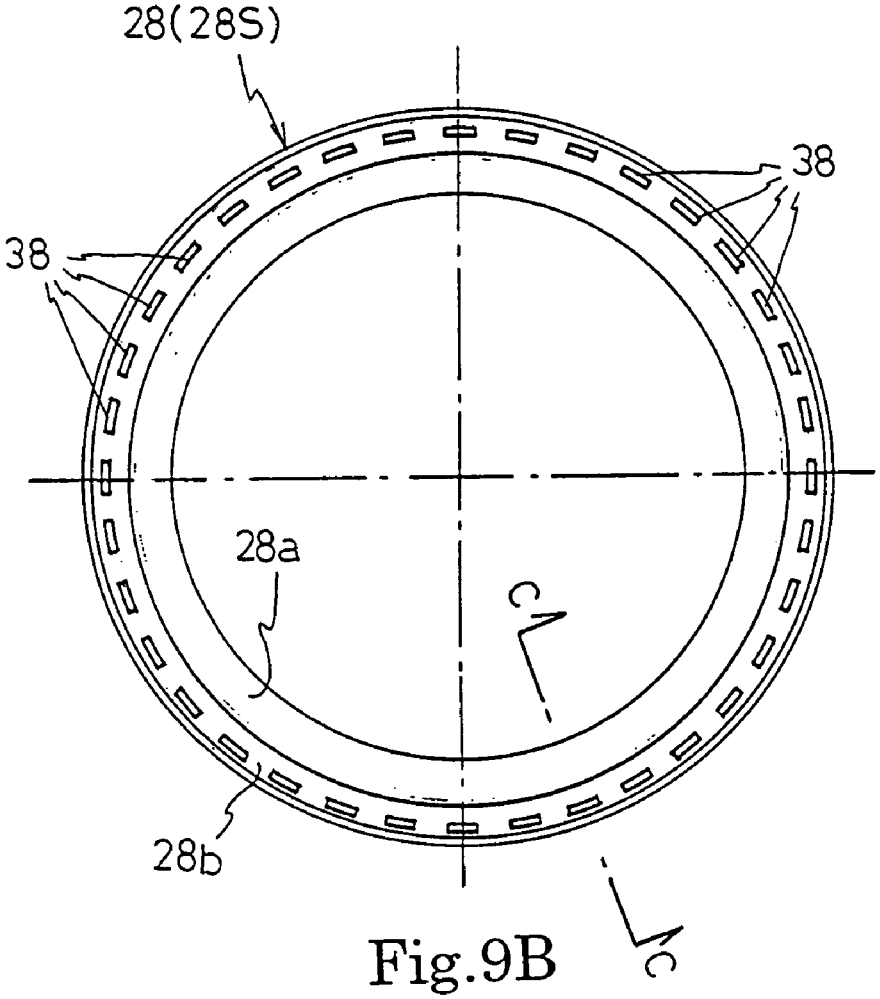
Figure 9B:
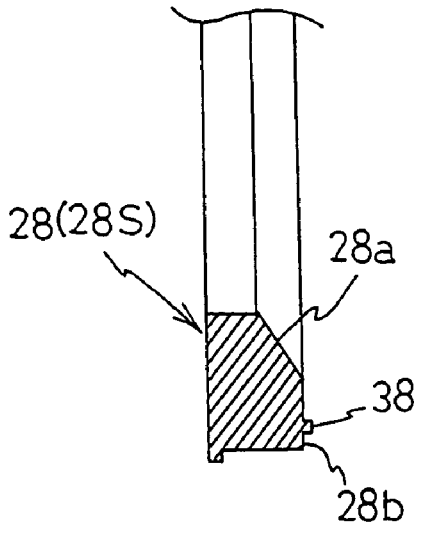

Furthermore, as shown in FIGS. 8A and 8B for example, the sizing ring 18S used as the sizing ring 18 installed on the rotor 16 has spike-shaped projecting portions 37 formed in two rows in a radial direction from the axis of rotation, at prescribed intervals in the radial direction and circumferential direction, on the plate surface of the ring 18. As shown in FIGS. 9A and 9B, the sizing stator 28S used as the sizing stator 28 which opposes the sizing ring 18S has projecting portions 38 that pass between the projecting portions 37 which are formed in two rows on the sizing ring 18, these projecting portions 38 being formed in one row at prescribed intervals in the circumferential direction on a vertical surface 28*b* which connects with the inclined surface 28*a* of the sizing stator 28. In this case, even if the powder based granules being processed is entirely hard material, such as dry block material, or material having a hard core, this material is disintegrated and the particle size is regulated efficiently by the projecting portions 37 and 38. The powder based granules being processed is output to the exterior without settling in the disintegrating and sizing section B.

Moreover, it is also possible to use a sizing ring 18S having projecting portions 37 as described above for the sizing ring 18 which is installed on the rotor 16, and to use a standard flat sizing stator 28F for the sizing stator 28 which opposes the sizing ring 18S. If a ring and a stator which both have spike-shaped projecting portions as described above are used, then the maximum gap becomes larger and there is a risk of larger particles escaping, but in the case of a combination of a sizing ring 18S having these projecting portions and a flat sizing stator 28F, the escape of these particles is restricted and it is possible to narrow the particle size distribution even when processing a dry block material, or the like. Therefore, a combination of this kind is suitable when it is necessary to obtain a narrow particle size distribution.

Furthermore, if the supplied material comprises large coarse and dry particles, for example, then the disintegrating pins 19 attached to the front side plate surface of the rotor 16 have the action of roughly disintegrating the large coarse dry particles, and preventing the large coarse dry particles from settling in the gap section A. However, if the material being processed does not require rough disintegrating, then it is also possible to remove these disintegrating pins 19. Moreover, the auxiliary pins 20 also have the action of pushing the powder based granules, which enters into the gap section A that forms a settlement region for the powder based granules due to the centrifugal force caused by the rotation of the rotor 16, rapidly into the disintegrating and sizing section B, rather than settling in the gap section A. When the shape of these auxiliary pins 20 was changed as appropriate to a circular shape, rectangular shape, square shape, triangular shape, or the like, when observed in plan view, and the installation angle of these pins was also modified accordingly and their effect in pushing out the powder based granules material was observed, it was found that a desirable configuration is one where the pins are substantially triangular in shape and are installed in such a manner that one apex of this triangular shape faces in the direction of rotation of the rotor 16. If the powder based granules being processed is wet and there seems to be a risk that these auxiliary pins 20 may knead the powder based granules, then adherence of material tends to be promoted starting from these auxiliary pins 20, and it may be preferable to omit the auxiliary pins 20.

The powder based granules disintegrating and sizing device relating to the present invention which has the composition described above operates in the following manner.

Firstly, a sizing ring 18 and a sizing stator 28 are installed on the rotor 16 and the front cover 4 respectively, using a combination of a sizing ring 18 and a sizing stator 28 which are respectively flat, grooved or provided with projecting portions, in accordance with the properties of the powder based granules being processed. Subsequently, the projecting position adjustment mechanism 35 of the sizing stator 28 is operated and the gap of the disintegrating and sizing section (narrowest gap section) B is adjusted in accordance with the target particle size of the powder based granules being processed.

The front cover 4 is then closed, the electromagnetic lock safety door switch 7 is released, and the motor 13 which turns the drive shaft 9 is driven, in addition to which compressed air is supplied to the air supply port 14*a* of the air seal section 15.

Once the flow of air created inside the casing 2 by the rotation of the rotor 16 has stabilized, then a powder based granules raw material such as a wet agglomerated material which is granulated or molded by one of various types of device, is supplied from the hopper 25. The powder based granules raw material thus supplied flows down the chute 26 and enters into the casing 2 via the raw material supply port 24. The powder based granules raw material which has flowed into the casing 2 receives a centrifugal force created by the rotation of the rotor 16 and is propelled in a radial direction from the center of the rotor, is firstly disintegrated roughly by the disintegrating pins 19. The powder based granules which arrives at the gap section A between the front side plate surface 16*b* of the rotor 16 and the inclined surface 28*a* of the sizing stator 28 is pushed out rapidly into the disintegrating and sizing section B, rather than settling in the gap section A, due to the centrifugal force created by the rotation of the rotor 16 and the extruding force created by the action of the auxiliary pins 20, and so on.

The powder based granules which is pushed out into the disintegrating and sizing section B, particles which match the gap settings are allowed to pass directly, but non-matching particles are disintegrated between the sizing ring 18 installed on the rotor 16 and the vertical surface 28*b* of the sizing stator 28. In particular, if the sizing ring 18S and the sizing stator 28S which have projecting portions 37 and 38 are used, then even if the material being processed is a dry block material which is entirely hard, or which has a hard core, this material can be disintegrated and regulated in size efficiently by the projecting portions 37 and 38 provided in the disintegrating and sizing section B. Furthermore, the powder based granules does not settle in the disintegrating and sizing section B, but rather is output smoothly in the direction of the outer circumference of the rotor 16. The output material travels on the flow of air formed inside the casing 2 by the rotation of the rear vanes 21, and exits to the exterior of the system from the product outlet port 22 provided in the lower circumferential surface portion of the casing 2 and via the output chute 23, without adhering to the inner walls of the casing 2.

Above, preferred embodiments of a powder based granules disintegrating and sizing device relating to the present invention were described, but the present invention is not limited to any of the embodiments described above, and it is of course possible for various modifications or changes to be implemented within the technical scope of the present invention as described in the claims.

For example, the projecting position adjustment mechanism 35 of the sizing stator 28 described in the present embodiment is no more than an example, and any structure which is capable of adjusting the position of the sizing stator 28 disposed inside the casing 2, from the outside of the casing 2, is included in the technical scope of the present invention.

Moreover, the structure of the air seal section 15 between the bearings 11, 11 of the drive shaft 9 and the casing 2 described in the aforementioned embodiments is not limited to the structure of any of the embodiments described above, and it is also possible to employ various currently known structures for the air seal section 15.

Figure 10:
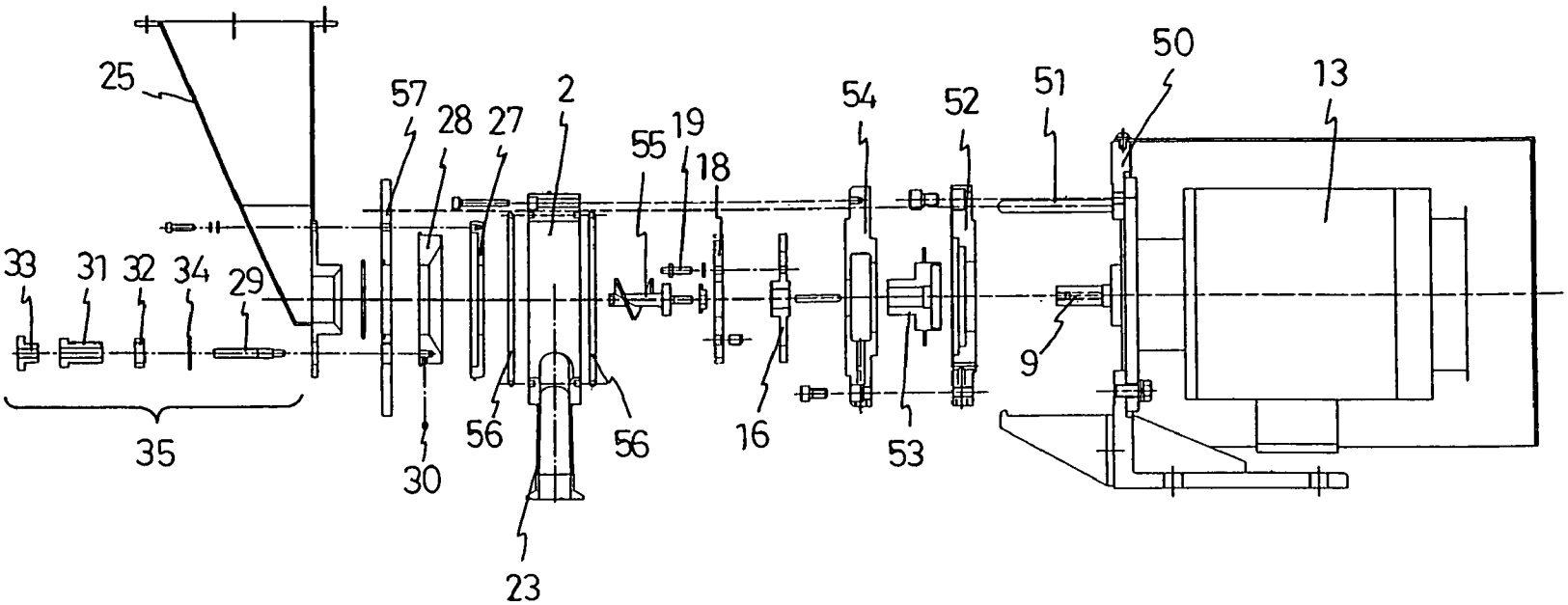
FIG. 10 is an exploded side view showing a further embodiment of a powder based granules disintegrating and sizing device relating to the present invention.
Figure 11:
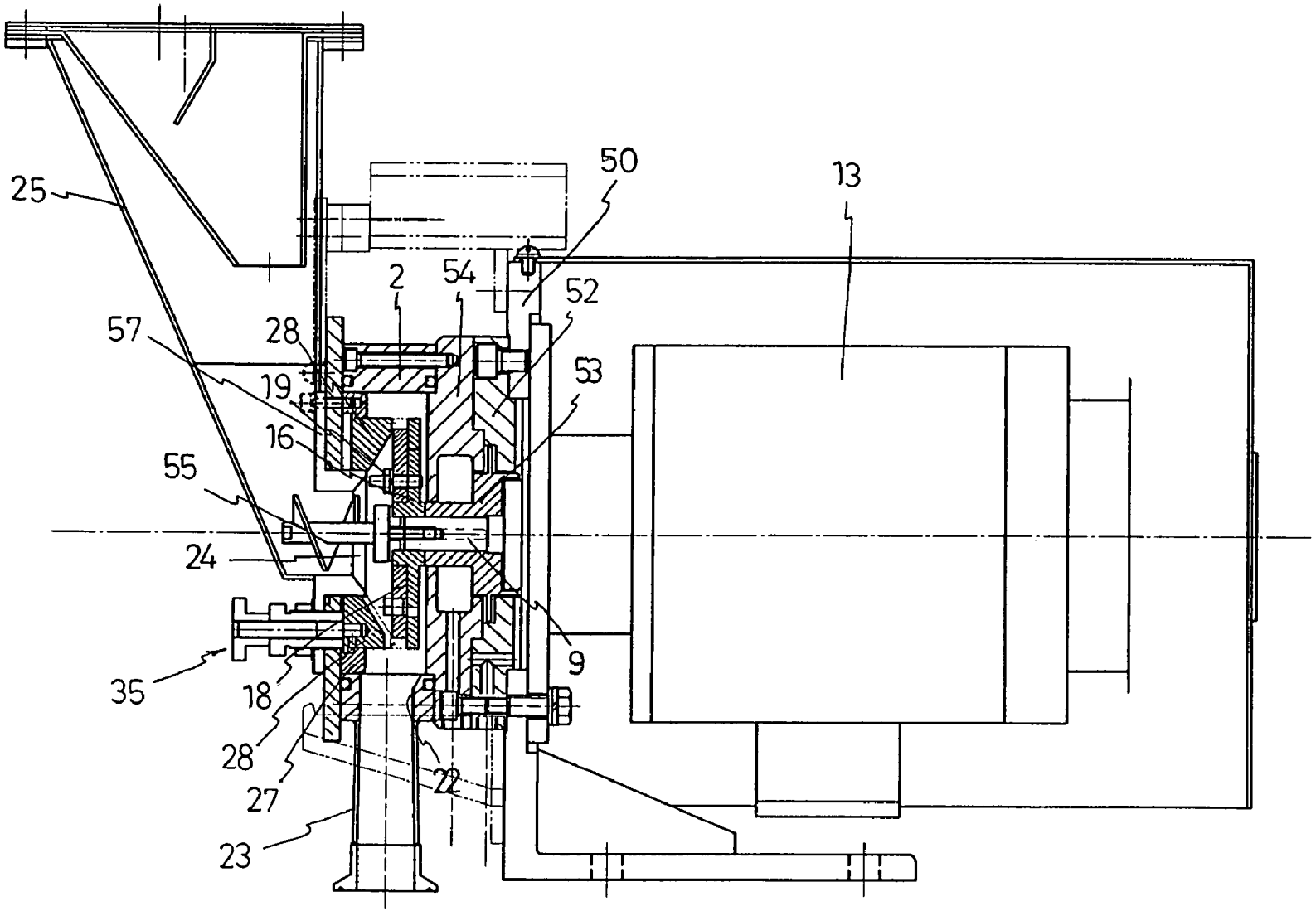
FIG. 11 is a vertical cross-sectional side view showing a state where the powder based granules disintegrating and sizing device shown in FIG. 10 is assembled.

Furthermore, as shown in FIG. 10 and FIG. 11, a structure may also be employed in which the respective members which constitute the sizing mechanism are assembled successively on a motor mounting 50. If a structure of this kind is adopted, then the freedom of overall design of the device is increased, and it is possible to make various design modifications, as well as further reducing the overall size of the device. In FIG. 10 and FIG. 11, numeral 51 denotes a guide bar which is erected in a standing fashion on the motor mounting 50, numeral 52 denotes a bracket, numeral 53 denotes a collar, numeral 54 denotes a casing holder, numeral 55 denotes a screw, numeral 56 denotes packing, and numeral 57 denotes a front cover. The other members are the same as those of the embodiments described above, and they are labeled with the same reference numerals and are not described further here. In particular, in this embodiment, the powder based granules disintegrating and sizing device according to the present invention is compact in size and if the raw material supply port 24 is not formed widely, as shown in FIG. 11, then the screw 55 has the effect of preventing the settlement of raw material in the vicinity of this raw material supply port 24.

EXPERIMENTAL EXAMPLES

Comparison Experiment with Prior Art Device: Prevention of Excessive Disintegrating

Experimental Example 1

A disintegrating and sizing process was carried out on the raw material described below, under the conditions described below, using a prior art device as described in Patent Document 2 (Japanese Patent Application Publication No. 2005-131609).

Raw material: churned lactose—corn starch granules

Rotor diameter: 235 mm

Narrowest gap section: 0.5 mm

Speed of rotor: 3500 rpm

Type of sizing surface: both flat

Experimental Example 2

A disintegrating and sizing process was carried out on the raw material described below, under the conditions described below, using an device according to the present invention as shown in FIG. 1 to FIGS. 6A and 6B.

Raw material: churned lactose—corn starch granules

Rotor diameter: 235 mm

Narrowest gap section: 0.5 mm

Number of rotations of rotor: 3500 rpm

Type of sizing surface: both flat

Experimental Example 3

A disintegrating and sizing process was carried out on the raw material described below, under the conditions described below, using a prior art device as described in Patent Document 2 (Japanese Patent Application Publication No. 2005-131609).

Raw material: churned lactose—corn starch granules

Rotor diameter: 235 mm

Narrowest gap section: 0.5 mm

Number of rotations of rotor: 3500 rpm

Type of sizing surface: both spiked

Experimental Example 4

A disintegrating and sizing process was carried out on the raw material described below, under the conditions described below, using an device according to the present invention as shown in FIG. 1 to FIGS. 6A and 6B, FIGS. 8A and 8B, and FIGS. 9A and 9B.

Raw material: churned lactose—corn starch granules

Rotor diameter: 260 mm

Narrowest gap section: 0.5 mm

Number of rotations of rotor: 3500 rpm

Type of sizing surface: both spiked

Experimental Results

The results of these experiments are shown in Table 1.

TABLE 1

| | Raw Material | | | Particle size | | |
|---|---|---|---|---|---|---|
| | Particle size > 850 μm | Particle size ≦ 105 μm | Water content | >850 μm | >105 μm, ≦850 μm | ≦105 μm |
| Experimental example 1 | 54.57% | 11.32% | 19.5% | 2.7% | 92.6% | 4.7% |
| Experimental example 2 | | | | 1.0% | 97.3% | 1.7% |
| Experimental example 3 | | | | 1.8% | 93.2% | 5.0% |
| Experimental example 4 | | | | 0.7% | 95.7% | 3.6% |

In experimental example 1 (prior art device), the presence of fine-particles was approximately 5%, but in the experimental example 2 (the device of the present invention), the amount of fine-particles had reduced to approximately 2%. Furthermore, in the experimental example 2 (the device of the present invention), it was also possible to reduce the ratio of large coarse particles having a size of 850 μm or greater. From this, it could be confirmed that a narrow particle size distribution is obtained with the device according to the present invention.

Moreover, similarly, in the experimental example 3 (the device according to the present invention), the presence of fine-particles was 5%, whereas in the experimental example 4 (the device according to the present invention), the amount of fine-particles was reduced to approximately 4%. Furthermore, in the experimental example 4 (the device according to the present invention), the amount of large coarse particles having a size of 850 μm or greater was also reduced. From these findings, it could be confirmed that a relatively narrow particle size distribution is obtained, regardless of the form of the sizing surfaces.

Comparison Experiment with the Device According to the Prior Art: Improvement in Processing Capacity

Experimental Example 5

A disintegrating and sizing process was carried out on the raw material described below, under the conditions described below, using a prior art device as described in Patent Document 2 (Japanese Patent Application Publication No. 2005-131609).

Raw material: herbal medicine

Rotor diameter: 235 mm

Narrowest gap section: 0.9 mm

Number of rotations of rotor: 3500 rpm

Type of sizing surface: both flat

Experimental Example 6

A disintegrating and sizing process was carried out on the raw material described below, under the conditions described below, using an device according to the present invention as shown in FIG. 1 to FIGS. 6A and 6B.

Raw material: herbal medicine

Rotor diameter: 235 mm

Narrowest gap section: 0.9 mm

Number of rotations of rotor: 3500 rpm
Type of sizing surface: both flat

Experimental Results

Figure 12:
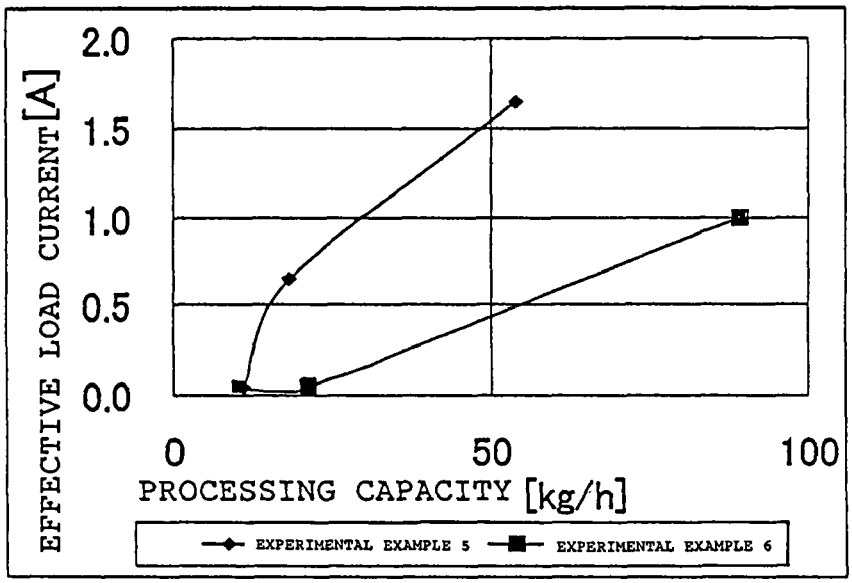
FIG. 12 is a graph showing the relationship between the processing capacity and the effective load current value in an experimental example 5 and an experimental example 6.

The results of the experiments are shown in Table 2 and FIG. 12.

TABLE 2

| | Raw Material | | | Processing conditions | | Processing results | |
|---|---|---|---|---|---|---|---|
| | Particle size Dp50 | Particle size Dp80 | Water content | Input volume | Effective load current | Particle size Dp50 | Particle size Dp80 |
| Experimental example 5 | 0.7 mm | 1.0 mm | 5.6% | 11 g/h | 0.05 A | 0.6 mm | 0.8 mm |
| | | | | 18 g/h | 0.65 A | 0.6 mm | 0.8 mm |
| | | | | 54 g/h | 1.65 A | 0.6 mm | 0.9 mm |
| Experimental example 6 | | | | 10 g/h | 0.05 A | 0.6 mm | 0.8 mm |
| | | | | 21 g/h | 0.05 A | 0.6 mm | 0.8 mm |
| | | | | 89 g/h | 1.0 A | 0.6 mm | 0.9 mm |

In experimental example 5 (the device according to the prior art), the effective load current value rose suddenly with the increase in the processing capacity, but in experimental example 6 (the device according to the present invention), the effective load current value did not increase significantly at a processing capacity equal to or greater than that in the experimental example 5. Furthermore, for example, from FIG. 12, at a processing capacity of 50 kg/h in experimental example 5, the effective load current value was approximately 1.5 A, but at a processing capacity of 50 kg/h in experimental example 6, it was estimated that the effective load current values was under 0.5 A. By this means, it could be confirmed that the processing capacity can be increased by adopting the device according to the present invention.

Comparison Experiment in Relation to Form of Sizing Surface: with Processing Material Having High Adhesive Properties Experimental Example 7

A disintegrating and sizing process was carried out on the raw material described below, under the conditions described below, using an device according to the present invention as shown in FIG. 1 to FIGS. 6A and 6B.

Raw material: herbal medicine

Rotor diameter: 235 mm

Narrowest gap section: 1.0 mm

Number of rotations of rotor: 3500 rpm

Type of sizing surface: both flat

Experimental Example 8

A disintegrating and sizing process was carried out on the raw material described below, under the conditions described below, using an device according to the present invention as shown in FIG. 1 to FIGS. 7A and 7B.

Raw material: herbal medicine

Rotor diameter: 235 mm

Narrowest gap section: 1.0 mm

Number of rotations of rotor: 3500 rpm

Type of sizing surface: combination of grooved (sizing ring) and flat (sizing stator)

Experimental Results

The results of the experiments are shown in Table 3.

TABLE 3

| | Raw Material | | | Processing Conditions | | | Processing Results | |
|---|---|---|---|---|---|---|---|---|
| | Particle size Dp50 | Particle size Dp80 | Water content | Input volume | Effective load current | Processing time | Particle size Dp50 | Particle size Dp80 |
| Experimental example 7 | 0.23 mm | 0.59 mm | 40.5% | 47 kg/h | 1.5 → 3.3 | 2 min | 0.16 mm | 0.58 mm |
| Experimental example 8 | | | | 48 kg/h | 1.5 | 3 min | 0.16 mm | 0.58 mm |

In experimental example 7, the load current value rises due to the occurrence of adhesion of material as the processing advances, and hence a stable experiment could not be carried out. However, in experimental example 8, there was no change in the current value even after three minutes had elapsed under the same processing conditions, and hence a stable experiment could be carried out. From these findings, it could be confirmed that for the sizing surfaces, a combination of a grooved surface (sizing ring) and a flat surface (sizing stator) is suitable for processing a powder based granules which has strong adhesive properties.

Comparison Experiment in Relation to Form of Sizing Surface: with Hard Processing Material Experimental Example 9

A disintegrating and sizing process was carried out on the raw material described below, under the conditions described below, using an device according to the present invention as shown in FIG. 1 to FIGS. 6A and 6B.

Raw material: herbal medicine

Rotor diameter: 235 mm

Narrowest gap section: 0.5 mm
Number of rotations of rotor: 3500 rpm
Type of sizing surface: both flat Experimental Example 10

A disintegrating and sizing process was carried out on the raw material described below, under the conditions described below, using an device according to the present invention as shown in FIG. 1 to FIGS. 6A and 6B, FIGS. 8A and 8B, and FIGS. 9A and 9B.

Raw material: herbal medicine
Rotor diameter: 260 mm
Narrowest gap section: 0.5 mm
Number of rotations of rotor: 3500 rpm
Type of sizing surface: combination of spiked (sizing ring) and flat (sizing stator)

Experimental Results

Figure 13:
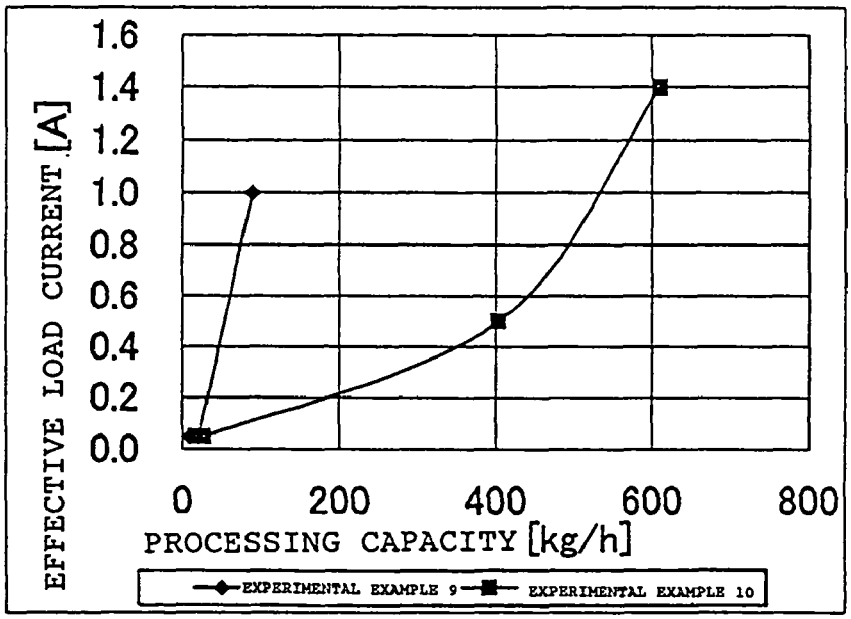
FIG. 13 is a graph showing the relationship between the processing capacity and the effective load current value in an experimental example 9 and an experimental example 10.

The results of the experiments are shown in Table 4 and FIG. 13.

TABLE 4

| | Raw Material | | | Processing conditions | | Processing results | |
|---|---|---|---|---|---|---|---|
| | Particle size Dp50 | Particle size Dp80 | Water content | Input volume | Effective load current | Particle size Dp50 | Particle size Dp80 |
| Experimental example 9 | 0.7 mm | 1.0 mm | 5.6% | 10 kg/h | 0.05 A | 0.6 mm | 0.8 mm |
| | | | | 21 kg/h | 0.05 A | 0.6 mm | 0.8 mm |
| | | | | 89 kg/h | 1.0 A | 0.64 mm | 0.89 mm |
| Experimental example 10 | | | | 17 kg/h | 0.05 A | 0.58 mm | 0.77 mm |
| | | | | 27 kg/h | 0.05 A | 0.58 mm | 0.77 mm |
| | | | | 404 kg/h | 0.5 A | 0.63 mm | 0.85 mm |
| | | | | 610 kg/h | 1.4 A | 0.61 mm | 0.8 mm |

In the experimental example 9, processing did not advance due to the fact that the raw material comprises hard particles, and the load current value increased due to the low processing capacity. However, in the experimental example 10, the load current value was low under the same processing conditions, and hence processing of a large volume of material was possible, and there were no effects on the particle size of the final product. From this, it could be confirmed that for the sizing surfaces a combination of a spiked surface (sizing ring) and a flat surface (sizing stator) is suitable for the processing of hard powder based granules material.

INDUSTRIAL APPLICABILITY

According to the powder based granules disintegrating and sizing device according to the present invention which was described above, a disintegrating and sizing section is formed over the whole circumference of the rotor and therefore it is possible to disintegrate and regulate the size of the powder based granules efficiently. Furthermore, since the processed powder based granules is supplied in the vicinity of the center of the rotor and flows due to the centrifugal force of the rotor from the center toward the outer circumference of the rotor, where it receives a disintegrating and sizing action and is then output directly in the direction of the outer circumference, the flow of the powder based granules inside the device is smooth and it is possible to prevent adherence of the processed material to the internal walls of the device as well as avoiding excessive disintegrating, in addition to which the processing amount can be increased. Therefore, the powder based granules disintegrating and sizing device according to the present invention is appropriate for use in regulating the various wet or dry materials to a prescribed particle size, such as pharmaceuticals, food products, feed materials, chemicals, fertilizers, fine coals, limestone, ceramic materials or the like, which have been granulated or molded articles by various types of devices.

The invention claimed is:

1. A powder based granules disintegrating and sizing device, comprising:

a drive shaft which is provided in a horizontal direction inside a casing;

a rotor which is fixed to the drive shaft;

a sizing stator which is provided so as to oppose a plate surface of a circumferential edge portion of the rotor and has an inclined surface which reduces a gap with respect to the plate surface of the rotor toward the circumferential edge thereof; and a gap section where the powder based granules settles being formed by the plate surface of the rotor and the inclined surface of the sizing stator, and a disintegrating and sizing section being formed by a narrowest gap section between the circumferential edge of the rotor and the sizing stator, wherein the drive shaft is supported in a cantilever fashion, the rotor is fixed to an open side end portion thereof, the sizing stator is installed over the whole circumference of the rotor, a raw material supply port is opened in the vicinity of the central portion of the rotor, and a product output port is opened in the vicinity of a position directly below the rotor, wherein a cutaway section is formed in the circumferential edge of the rotor on the front side thereof, and a sizing ring is installed in the cutaway section, and wherein two types of sizing stator are provided, one having a flat sizing surface and one having a sizing surface formed with projecting portions, and three types of sizing ring are provided, one having a flat sizing surface, one having a sizing surface formed with grooves and one having a sizing surface formed with projecting portions, the sizing stator and the sizing ring being installed on the front cover and the rotor respectively, in accordance with the properties of the powder based granules which is subjected to sizing processing.

2. The powder based granules disintegrating and sizing device according to claim 1, wherein an air seal section is provided between a bearing section of the drive shaft and the casing.

3. The powder based granules disintegrating and sizing device according to claim 1, wherein disintegrating pins which roughly crush the powder based granules are provided on a front side plate surface of the rotor.

4. The powder based granules disintegrating and sizing device according to claim 1, wherein auxiliary pins which press the powder based granules in the direction of the disintegrating and sizing section are provided on a front side plate surface of the rotor.

5. The powder based granules disintegrating and sizing device according to claim 1, further comprising an adjustment mechanism for adjusting the projecting position of the sizing stator, the adjustment mechanism including:

a stud bolt fixed to the sizing stator, the stud bolt penetrating the front cover;

a spacer freely fitting around the stud bolt and threadedly engaging with the front cover to fix the position of the spacer relative to the front cover;

a knurled knob threadedly engaging with the stud bolt, the knurled knob and the sizing stator pinching the spacer therebetween; and a nut threadedly engaging around the spacer to secure the fixing between the spacer and the front cover, wherein the adjustment mechanism allows adjusting a position of the sizing stator relative to the front cover.

6. The powder based granules disintegrating and sizing device according to claim 5, wherein a plurality of the adjustment mechanism is disposed on the front cover at equal distances about a circle in the outer portion thereof.

7. The powder based granules disintegrating and sizing device according to claim 5, wherein the adjustment mechanism has a gauge plate with measurement markings that show a rotational angle of the spacer.

8. A powder based granules disintegrating and sizing device, comprising:

a drive shaft which is provided in a horizontal direction inside a casing;

a rotor which is fixed to the drive shaft;

a sizing stator which is provided so as to oppose a plate surface of a circumferential edge portion of the rotor and has an inclined surface which reduces a gap with respect to the plate surface of the rotor toward the circumferential edge thereof; and a gap section where the powder based granules settles being formed by the plate surface of the rotor and the inclined surface of the sizing stator, and a disintegrating and sizing section being formed by a narrowest gap section between the circumferential edge of the rotor and the sizing stator, wherein the drive shaft is supported in a cantilever fashion, the rotor is fixed to an open side end portion thereof, the sizing stator is installed over the whole circumference of the rotor, a raw material supply port is opened in the vicinity of the central portion of the rotor, and a product output port is opened in the vicinity of a position directly below the rotor, wherein the casing is constituted by a casing main body having a bottomed cylindrical shape and a front cover which seals the open end of the casing main body, the raw material supply port is opened in the central portion of the front cover, and the product output port is opened in the lower circumferential surface portion of the casing main body, wherein a cutaway section is formed in the circumferential edge of the rotor on the front side thereof, and a sizing ring is installed in the cutaway section, and wherein two types of sizing stator are provided, one having a flat sizing surface and one having a sizing surface formed with projecting portions, and three types of sizing ring are provided, one having a flat sizing surface, one having a sizing surface formed with grooves and one having a sizing surface formed with projecting portions, the sizing stator and the sizing ring being installed on the front cover and the rotor respectively, in accordance with the properties of the powder based granules which is subjected to sizing processing.

9. The powder based granules disintegrating and sizing device according to claim 8, wherein an air seal section is provided between a bearing section of the drive shaft and the casing.

10. The powder based granules disintegrating and sizing device according to claim 8, wherein disintegrating pins which roughly crush the powder based granules are provided on a front side plate surface of the rotor.

11. The powder based granules disintegrating and sizing device according to claim 8, wherein auxiliary pins which press the powder based granules in the direction of the disintegrating and sizing section are provided on a front side plate surface of the rotor.

12. The powder based granules disintegrating and sizing device according to claim 8, further comprising an adjustment mechanism for adjusting the projecting position of the sizing stator, the adjustment mechanism including:

a stud bolt fixed to the sizing stator, the stud bolt penetrating the front cover;

a spacer freely fitting around the stud bolt and threadedly engaging with the front cover to fix the position of the spacer relative to the front cover;

a knurled knob threadedly engaging with the stud bolt, the knurled knob and the sizing stator pinching the spacer therebetween; and a nut threadedly engaging around the spacer to secure the fixing between the spacer and the front cover, wherein the adjustment mechanism allows adjusting a position of the sizing stator relative to the front cover.

13. The powder based granules disintegrating and sizing device according to claim 12, wherein a plurality of the adjustment mechanism is disposed on the front cover at equal distances about a circle in the outer portion thereof.

14. The powder based granules disintegrating and sizing device according to claim 12, wherein the adjustment mechanism has a gauge plate with measurement markings that show a rotational angle of the spacer.

15. A powder based granules disintegrating and sizing device, comprising:

a drive shaft which is provided in a horizontal direction inside a casing;

a rotor which is fixed to the drive shaft;

a sizing stator which is provided so as to oppose a plate surface of a circumferential edge portion of the rotor and has an inclined surface which reduces a gap with respect to the plate surface of the rotor toward the circumferential edge thereof; and a gap section where the powder based granules settles being formed by the plate surface of the rotor and the inclined surface of the sizing stator, and a disintegrating and sizing section being formed by a narrowest gap section between the circumferential edge of the rotor and the sizing stator, wherein the drive shaft is supported in a cantilever fashion, the rotor is fixed to an open side end portion thereof, the sizing stator is installed over the whole circumference of the rotor, a raw material supply port is opened in the vicinity of the central portion of the rotor, and a product output port is opened in the vicinity of a position directly below the rotor, wherein the casing is constituted by a casing main body having a bottomed cylindrical shape and a front cover which seals the open end of the casing main body, the raw material supply port is opened in the central portion of the front cover, and the product output port is opened in the lower circumferential surface portion of the casing main body, wherein the sizing stator is installed on the front cover in such a manner that the projecting position thereof can be adjusted, wherein a cutaway section is formed in the circumferential edge of the rotor on the front side thereof, and a sizing ring is installed in the cutaway section, and wherein two types of sizing stator are provided, one having a flat sizing surface and one having a sizing surface formed with projecting portions, and three types of sizing ring are provided, one having a flat sizing surface, one having a sizing surface formed with grooves and one having a sizing surface formed with projecting portions, the sizing stator and the sizing ring being installed on the front cover and the rotor respectively, in accordance with the properties of the powder based granules which is subjected to sizing processing.

16. The powder based granules disintegrating and sizing device according to claim 15, wherein an air seal section is provided between a bearing section of the drive shaft and the casing.

17. The powder based granules disintegrating and sizing device according to claim 15, wherein disintegrating pins which roughly crush the powder based granules are provided on a front side plate surface of the rotor.

18. The powder based granules disintegrating and sizing device according to claim 15, further comprising an adjustment mechanism for adjusting the projecting position of the sizing stator, the adjustment mechanism including:

a stud bolt fixed to the sizing stator, the stud bolt penetrating the front cover;

a spacer freely fitting around the stud bolt and threadedly engaging with the front cover to fix the position of the spacer relative to the front cover;

a knurled knob threadedly engaging with the stud bolt, the knurled knob and the sizing stator pinching the spacer therebetween; and a nut threadedly engaging around the spacer to secure the fixing between the spacer and the front cover, wherein the adjustment mechanism allows adjusting a position of the sizing stator relative to the front cover.

19. The powder based granules disintegrating and sizing device according to claim 18, wherein a plurality of the adjustment mechanism is disposed on the front cover at equal distances about a circle in the outer portion thereof.

20. The powder based granules disintegrating and sizing device according to claim 18, wherein the adjustment mechanism has a gauge plate with measurement markings that show a rotational angle of the spacer.

* * * * *